US008727705B2

(12) United States Patent
Inomata et al.

(10) Patent No.: US 8,727,705 B2
(45) Date of Patent: May 20, 2014

(54) STEAM TURBINE, METHOD OF COOLING STEAM TURBINE, AND HEAT INSULATING METHOD FOR STEAM TURBINE

(75) Inventors: Asako Inomata, Yokohama (JP); Katsuya Yamashita, Tokyo (JP); Kazuhiro Saito, Yokohama (JP); Takao Inukai, Kawasaki (JP); Kunihiko Wada, Yokohama (JP); Kazutaka Ikeda, Mitaka (JP); Takeo Suga, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 772 days.

(21) Appl. No.: 12/839,826

(22) Filed: Jul. 20, 2010

(65) Prior Publication Data

US 2011/0033281 A1 Feb. 10, 2011

(30) Foreign Application Priority Data

Aug. 7, 2009 (JP) ..... 2009-184406

(51) Int. Cl.
*F01D 1/24* (2006.01)

(52) U.S. Cl.
USPC ..... 415/117; 415/144; 415/180

(58) Field of Classification Search
USPC ..... 415/116, 117, 144, 177–180
See application file for complete search history.

(56) References Cited

U.S. PATENT DOCUMENTS

| | | | | |
|---|---|---|---|---|
| 2,987,983 | A * | 6/1961 | Solzman | 454/346 |
| 4,222,706 | A * | 9/1980 | Ayache et al. | 415/116 |
| 7,347,661 | B2 * | 3/2008 | Phipps et al. | 415/108 |
| 7,484,926 | B2 * | 2/2009 | Suga et al. | 415/108 |
| 8,202,037 | B2 * | 6/2012 | Deidewig et al. | 415/1 |
| 2009/0280005 | A1 * | 11/2009 | Schmitz et al. | 415/177 |

FOREIGN PATENT DOCUMENTS

| | | | |
|---|---|---|---|
| JP | 61-001809 | A | 1/1986 |
| JP | 2004-169562 | A | 6/2004 |
| JP | 2006-097544 | A | 4/2006 |
| JP | 2006-104951 | A | 4/2006 |

OTHER PUBLICATIONS

Office Action received in the related Japanese Patent Application No. 2009-184406, dated Dec. 18, 2012.
Office Action received in the related Chinese Patent Application No. 201010246861.X, dated Feb. 28, 2013.

* cited by examiner

*Primary Examiner* — Nathaniel Wiehe
*Assistant Examiner* — Woody A Lee, Jr.
(74) *Attorney, Agent, or Firm* — Foley & Lardner LLP

(57) ABSTRACT

A steam turbine 10 is provided with a double-structure comprising an inner casing 20 and an outer casing 21. A turbine rotor 22, in which plural stages of moving blades 24 are circumferentially implanted, is operatively disposed in inner casing 20. A diaphragm outer ring 25 and a diaphragm inner ring are disposed along the circumferential direction in inner casing 20. Stationary blades 27 are circumferentially provided between diaphragm outer ring 25 and the diaphragm inner ring, so that diaphragm outer ring 25, the diaphragm inner ring and stationary blades 27 form a stage of stationary blades. The stages of the stationary blades are arranged alternately with the stages of moving blades 24 in the axial direction of turbine rotor 22. A cooling medium passage 40 for passing a cooling medium CM which is supplied through a supply pipe 45 is formed between inner casing 20 and diaphragm outer ring 25.

10 Claims, 7 Drawing Sheets

STEAM TURBINE, METHOD OF COOLING STEAM TURBINE, AND HEAT INSULATING METHOD FOR STEAM TURBINE

CROSS REFERENCE TO RELATED APPLICATIONS

This application is based upon and claims the benefit of priority from the prior Japanese Patent Application No. 2009-184406, filed on Aug. 7, 2009; the entire contents of which are incorporated herein by reference.

FIELD

Embodiments described herein relate generally to a steam turbine, a method of cooling a steam turbine and a heat insulating method for a steam turbine, and particularly to a steam turbine using a high-temperature steam of about 650 to 750° C., a method of cooling a steam turbine and a heat insulating method for a steam turbine.

BACKGROUND

From the viewpoint of improving the efficiency of the steam turbine, a steam turbine using a main stream of steam having a temperature of about 600° C. has been realized. To further improve the efficiency of the steam turbine, research and development are underway for setting a temperature of the main stream of steam to about 650 to 750° C.

Since such a steam turbine has the main stream of steam of a high temperature, it is required to use a heat-resisting alloy for some component parts. But, the heat-resisting alloy is expensive and is hardly fabricated to produce large-size parts, so that the heat-resisting alloy cannot be used for some component parts. A portion configured of such component parts might have poor material strength when the steam temperature is increased to a high level. Accordingly, as described in, for example, JP-A 2006-104951 (KOKAI), a technology of suppressing material strength from lowering due to a high temperature by cooling the component parts which have a high temperature is under study.

JP-A 2006-104951 (KOKAI) describes a technology of cooling a diaphragm outer ring by forming a diaphragm outer ring supporting a stationary blade with a cooling passage for flowing cooling steam in a steam turbine having a double-structured casing which is comprised of an outer casing and an inner casing.

Since the steam turbine has a large casing, it is desirably made of not a heat-resisting alloy but a conventionally used heat-resisting steel from the viewpoint of production costs and production. And, a conventional steam turbine provided with a double-structure casing has a diaphragm outer ring for supporting a stationary blade, which is, for example, arranged partly in contact with an inner casing, so that heat tends to be conducted from the diaphragm outer ring to the inner casing. And, the conventional structure of cooling the diaphragm outer ring is not easy to sufficiently cool the inner casing which tends to have a high temperature in the double-structure casing.

DETAILED DESCRIPTION

Figure 1:
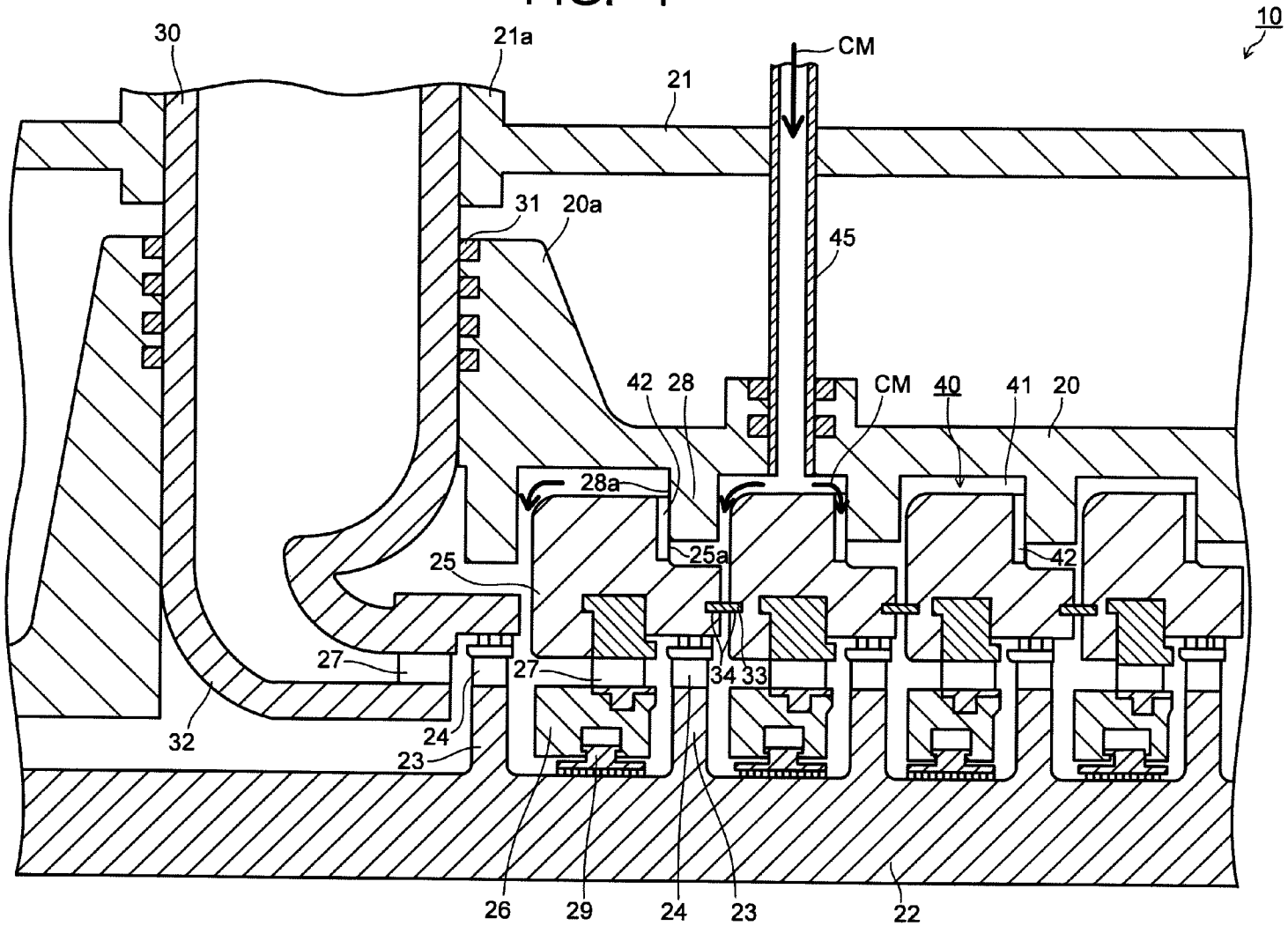
FIG. 1 is a diagram showing a cross section (meridional cross section) including the central axis of a turbine rotor of the steam turbine according to a first embodiment.

In an aspect of embodiments, there is provided a casing of a steam turbine provided with a double-structure casing, and particularly to a steam turbine capable of suppressing a temperature increase in an inner casing, a method of cooling a steam turbine and a heat insulating method for a steam turbine.

In another aspect of embodiments, there is provided a steam turbine comprising a double-structure casing comprising an outer casing and an inner casing; a steam inlet pipe disposed to communicate between an inlet portion of the outer casing and an inlet portion of the inner casing; a turbine rotor operatively disposed in the inner casing, the turbine rotor is implanted with plural stages of moving blades; plural stages of stationary blades circumferentially provided between a diaphragm outer ring and a diaphragm inner ring, the stages of the stationary blades are arranged alternately with the stages of the moving blades, respectively, in the axial direction of the turbine rotor; a cooling medium passage formed between the inner casing and the diaphragm outer ring to flow a cooling medium; a supply pipe that supplies the cooling medium to the cooling medium passage; and an exhaust passage that guides a working fluid, which has passed through a final stage moving blade, to an outside of the outer casing.

In another aspect of embodiments, there is provided a steam turbine comprising a double-structure casing comprising an outer casing and an inner casing; a steam inlet pipe disposed to communicate between an inlet portion of the outer casing and an inlet portion of the inner casing; a turbine rotor operatively disposed in the inner casing, the turbine rotor is implanted with plural stages of moving blades; plural stages of stationary blades circumferentially provided between a diaphragm outer ring and a diaphragm inner ring, the stages of the stationary blades are arranged alternately with the stages of the moving blades, respectively, in the axial direction of the turbine rotor; a plurality of protruded portions circumferentially protruded toward an inner radial direction with respect to the turbine rotor, each of the protruded portions respectively corresponds with each of the turbine stationary blades, and an exhaust passage that guides a working fluid, which has passed through a final stage moving blade, to an outside of the outer casing. Here, an upstream side surface of each of the protruded portions contacts with a downstream side surface of each of the diaphragm outer rings, respectively; and a heat insulating structure is provided at, at least one of the upstream side surface of the protruded portion and the downstream side surface of the diaphragm outer ring.

In another aspect of embodiments, there is provided a method of cooling a steam turbine comprising a double-structure casing comprising an outer casing and an inner casing; a steam inlet pipe disposed to communicate between an inlet portion of the outer casing and an inlet portion of the inner casing; a turbine rotor operatively disposed in the inner casing, the turbine rotor is implanted with plural stages of moving blades; plural stages of stationary blades circumferentially provided between a diaphragm outer ring and a diaphragm inner ring, the stages of the stationary blades are arranged alternately with the stages of the moving blades, respectively, in the axial direction of the turbine rotor; and an exhaust passage that guides a working fluid, which has passed through a final stage moving blade, to an outside of the outer casing, wherein the inner casing and the diaphragm outer ring are directly cooled by introducing a cooling medium into a cooling medium passage formed between the inner casing and the diaphragm outer ring through a supply pipe.

Another aspect of embodiments, there is provided a heat insulating method for a steam turbine comprising a double-structure casing comprising an outer casing and an inner casing; a steam inlet pipe disposed to communicate between an inlet portion of the outer casing and an inlet portion of the inner casing; a turbine rotor operatively disposed in the inner casing, the turbine rotor is implanted with plural stages of moving blades; plural stages of stationary blades circumferentially provided between a diaphragm outer ring and a diaphragm inner ring, the stages of the stationary blades are arranged alternately with each of the stages of the moving blades, respectively, in the axial direction of the turbine rotor; a plurality of protruded portions circumferentially protruded toward an inner radial direction with respect to the turbine rotor, each of the protruded portions respectively corresponds with the stages of the turbine stationary blades, wherein an upstream side surface of each of the protruded portions contacts with a downstream side surface of each of the diaphragm outer rings, respectively; and an exhaust passage that guides a working fluid, which has passed through a final stage moving blade, to an outside of the outer casing, wherein a heat insulating structure provided at least one of the upstream side surface of the protruded portion and the downstream side surface of the diaphragm outer ring, to block the transfer of heat from the diaphragm outer ring to the protruded portion.

Embodiments are described with reference to the drawings, which are provided for illustration only and do not limit the present invention in any aspect.

One embodiment is described below with reference to FIGS. 1 to 3.

First Embodiment

FIG. 1 is a diagram showing a cross section (meridional cross section) including the central axis of a turbine rotor 22 of a steam turbine 10 according to a first embodiment.

As shown in FIG. 1, the steam turbine 10 is provided with a double-structure casing which comprises an inner casing 20 and an outer casing 21 disposed outside of it. And, the turbine rotor 22 is operatively disposed within and through the inner casing 20. Plural moving blades 24 are circumferentially implanted in a rotor disk 23 of the turbine rotor 22 to configure a moving blade cascade (e.g. a stage of the moving blades). This moving blade cascade is formed in plural stages in the axial direction of the turbine rotor 22. The turbine rotor 22 is rotatably supported by an unshown rotor bearing.

A diaphragm outer ring 25 and a diaphragm inner ring 26 are disposed along the circumferential direction within the inner casing 20. Plural stationary blades 27 are circumferentially provided and supported between the diaphragm outer ring 25 and the diaphragm inner ring 26 to configure a stator blade cascade (e.g. a stage of the turbine stationary blades). This stator blade cascade is alternately arranged with the moving blade cascade in plural stages in the axial direction of the turbine rotor 22 to form plural turbine stages comprising stator blade cascades and moving blade cascades. Here, the diaphragm outer ring 25 and the diaphragm inner ring 26 are configured into a cylindrical shape by combining two semicylindrical members. Therefore, both ends of the semicylindrical members, which become a horizontal plane, have a flange portion (not shown) for fixing the semicylindrical members by mutually combining them.

A protruded portion 28 is circumferentially protruded toward an inner radial direction with respect to the central axis of the turbine rotor 22. Protruded portion 28 is circumferentially formed on the inner surface of the inner casing 20. Protruded portion 28 is formed in plural in the axial direction of the turbine rotor 22. Each of protruded portions 28, respectively, corresponds with the each of the stages of the turbine stationary blades, e.g. the stator blade cascade. An upstream side surface 28*a*, which is a side surface located on the upstream side of the protruded portion 28, is in contact with a downstream side surface 25*a*, which is a side surface located on the downstream side, of the diaphragm outer ring 25. Thus, the diaphragm outer ring 25 is arranged such that the downstream side surface 25*a* on the downstream side of the diaphragm outer ring 25 is contacted to the upstream side surface 28*a* of the protruded portion 28, to prevent the diaphragm outer ring 25 from moving to the downstream side in the axial direction of the turbine rotor 22.

A labyrinth seal portion 29 is provided on the diaphragm inner ring 26 on the side of the turbine rotor 22, to prevent steam from leaking between the diaphragm inner ring 26 and the turbine rotor 22. The labyrinth seal portion 29 has a structure divided into plural, for example, eight sections in the circumferential direction so to be inserted in the circumferential direction to fit into the groove portion formed in the inner circumference of the diaphragm inner ring 26.

The steam turbine 10 is provided with a steam inlet pipe 30, in which steam is introduced from outside, to communicate an inlet portion 21*a* of the outer casing 21 and an inlet portion 20*a* of the inner casing 20. And, the inner surface of the inlet portion 20*a* of the inner casing 20 is provided with a seal ring 31 to seal between the inner casing 20 and the steam inlet pipe 30.

The inlet portion 20*a* of the inner casing 20 is provided with a nozzle box 32. One end of the nozzle box 32 is connected to communicate with the steam inlet pipe 30. And, the other end of the nozzle box 32, namely the outlet, is configured with a stator blade cascade having a first stage stationary blade 27.

The steam turbine 10 is provided with an exhaust passage (not shown) which guides the steam, which is a working fluid having passed the final stage of moving blade 24 after flowing through alternately the stator blade cascades and the moving blade cascades in the inner casing 20 while performing the expansion work, from the interior of the inner casing 20 to outside.

A cooling medium passage 40 for allowing a cooling medium CM is formed between the inner casing 20 and the diaphragm outer ring 25. And, the cooling medium passage 40 is provided with a supply pipe 45 for supplying the cooling medium CM as shown in FIG. 1. The supply pipe 45 is formed through the outer casing 21 with its one end fitted into a through hole formed in the inner casing 20. Here, the supply pipe 45 is disposed to supply the cooling medium CM to the cooling medium passage 40 of the third turbine stage, but its position is not limited to it.

As the cooling medium CM, the steam extracted from another steam turbine, the steam discharged from another steam turbine, the steam extracted from the boiler and or the like can be used. When the steam turbine 10 is an intermediate-pressure turbine, the steam extracted from, for example, a high-pressure turbine can be used as the cooling medium CM. When the steam turbine 10 is a high-pressure turbine, the steam extracted from, for example, a boiler can be used as the cooling medium CM.

The cooling medium CM is preferably set to a temperature at which a large thermal stress is not caused in the parts such as the inner casing 20 and the diaphragm outer ring 25 to be cooled. Here, as a temperature at which a large thermal stress is not generated, it is preferably determined to be a temperature about 50 to 150° C. lower than the temperatures of the inner casing 20 and the diaphragm outer ring 25 in a state not being cooled. And, a supply pressure of the cooling medium CM is preferably a pressure at a level that for example, in the cooling medium passage 40 shown in FIG. 1, the cooling medium CM can flow to the downstream side (right side in FIG. 1) through the cooling medium passage 40 (see an arrow in FIG. 1) and to the cooling medium passage 40 corresponding to the final turbine stage. In addition, the supply pressure of the cooling medium CM is preferably a pressure at a level capable of flowing the cooling medium CM through the cooling medium passage 40 to the upstream side (left side in FIG. 1) (see an arrow in FIG. 1), flowing between the steam inlet pipe 30 sealed by the seal ring 31 and the inner surface of the inlet portion 20*a* of the inner casing 20, and flowing into the space between the inner casing 20 and the outer casing 21.

Here, a pressure loss, namely a passage resistance, in the passage when the cooling medium CM is flown to the upstream side (left side in FIG. 1) and downstream side (right side in FIG. 1) of the cooling medium passage 40 is appropriately determined by adjusting a passage cross-sectional area of a gap portion 41 formed between the inner surface of the inner casing 20 and the outer surface of the diaphragm outer ring 25 and of the groove portion 42 formed in the downstream side surface 25*a* of the diaphragm outer ring 25. Here, the inner surface of inner casing 20 includes both side surfaces and an inner circumferential surface of protruded portion 28. The outer surface of diaphragm outer ring 25 includes an outer circumferential surface and both side surfaces.

As shown in FIG. 1, it is preferable to dispose a cooling medium leakage preventing member 33 circumferentially between the mutually adjacent diaphragm outer rings 25 to prevent the cooling medium CM from flowing from the gap between the mutually adjacent diaphragm outer rings 25 into the passage where a main stream of steam flows. This cooling medium leakage preventing member 33 is made of, for example, the same heat resisting material as that forming the diaphragm outer ring 25 and composed of a plate-like member divided into plural parts in the circumferential direction. In other words, this cooling medium leakage preventing member 33 is configured into a cylindrical shape as a whole by combining the plate-like member divided into plural parts in the circumferential direction. For example, both ends of the individual plate-like members can also be configured to have a flange portion (not shown) for fixing by combining the mutually adjacent plate-like members in the circumferential direction. The individual plate-like members in the ring shape are fitted with fitting grooves 34 formed in the side surfaces of the adjacent and opposed diaphragm outer rings 25, so that it is possible to form a cylindrical shape as a whole without disposing the above-described flange portion.

The cooling medium passage 40 is described below in further detail.

Figure 2:
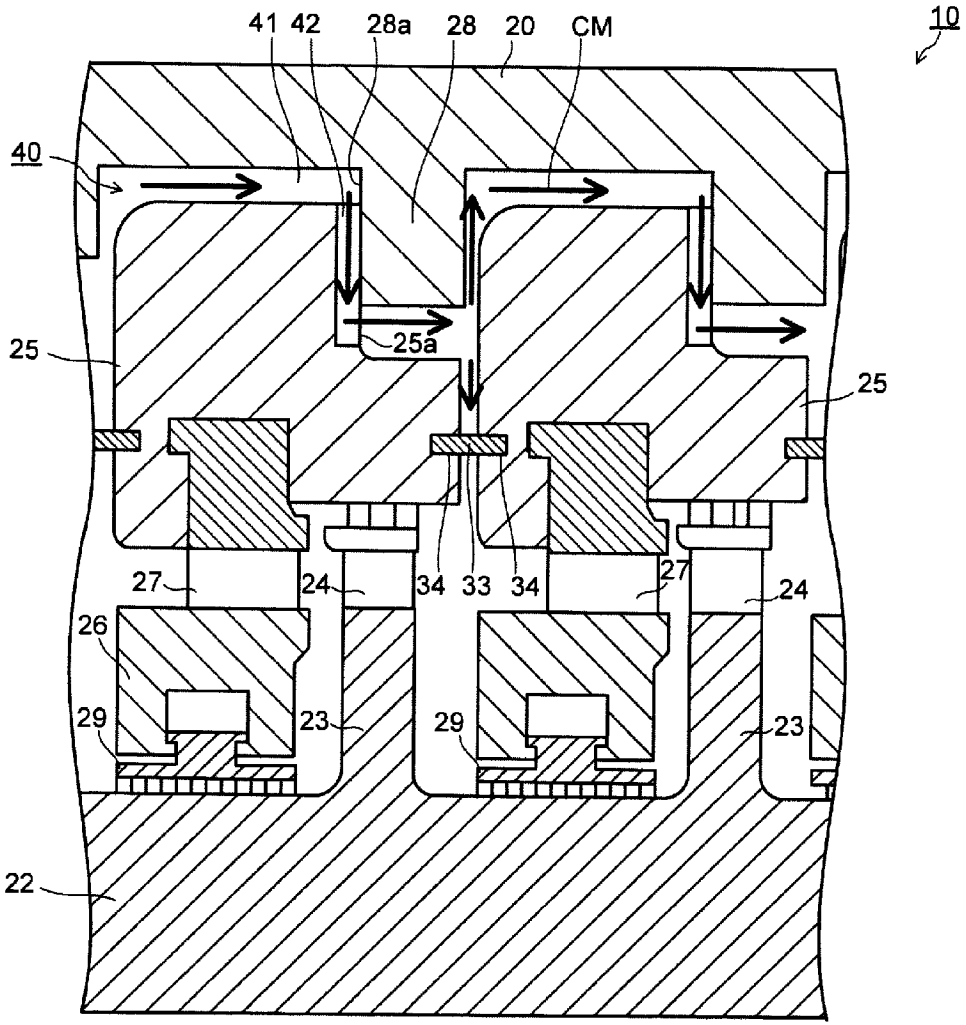
FIG. 2 is a diagram showing a cross section (meridional cross section) including the central axis of the turbine rotor for illustrating a structure of a cooling medium passage of the steam turbine according to the first embodiment.

FIG. 2 is a diagram showing a cross section (meridional cross section) including the central axis of the turbine rotor 22 for illustrating a structure of the cooling medium passage 40 of the steam turbine 10 according to the first embodiment. FIG. 3 is a plan view of a part of the downstream side surface 25*a* of the diaphragm outer ring 25 which is in contact with the upstream side surface 28*a* of the protruded portion 28 when viewed from the downstream side in the axial direction of the turbine rotor 22. FIG. 2 and FIG. 3 show the flow of the cooling medium CM by arrows.

As shown in FIG. 2, the cooling medium passage 40 comprises a plurality of gap portions 41 and a groove portion 42. Each of gap portions 41 corresponds with each of the stages of the turbine stationary blades (e.g. the turbine stator cascade). Each of gap portions 41 is configured of an inner surface of the inner casing 20 and an outer surface of at least one of the diaphragm outer rings 25, so that each of gap portions 41 is axially separated by protruded portions 28, respectively. Groove portion 42 is formed in a downstream side surface 25*a*, which is a side surface located on the downstream side of the diaphragm outer ring 25, in contact with a upstream side surface 28*a*, which is a side surface located on the upstream side of the protruded portion 28, and communicated with the gap portion 41. In other words, groove portion 41 couples and connects two of axially adjacently located gap portions 41 to communicate. As shown in FIG. 3, the groove portion 42 is formed to have a prescribed width in the downstream side surface 25*a* of the diaphragm outer ring 25 along the radial direction of the diaphragm outer ring 25 and formed in plural with prescribed intervals circumferentially.

Figure 3:
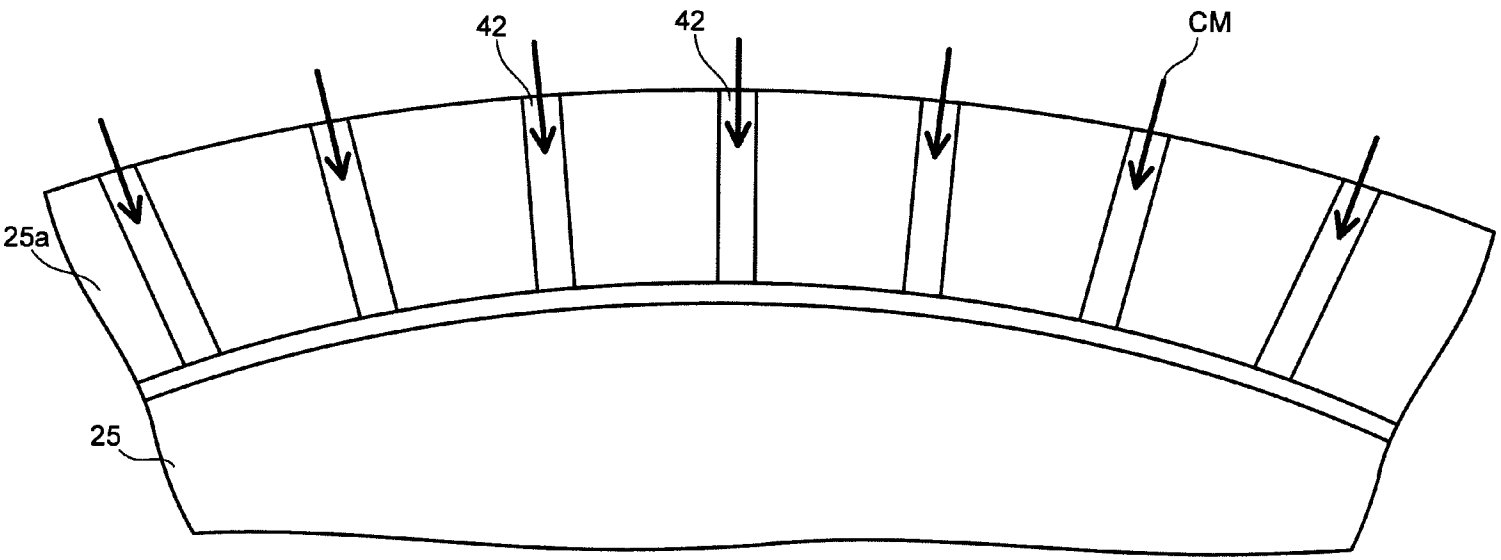
FIG. 3 is a plan view of a part of a side surface on the downstream side of a diaphragm outer ring in contact with a side surface on the upstream side of a protruded portion when viewed from the downstream side in the axial direction of the turbine rotor.

As shown in FIG. 2 and FIG. 3, the cooling medium CM flows partially through the gap portion 41 which is formed by the inner surface of the inner casing 20 and the outer surface of the diaphragm outer ring 25, flows through the groove portion 42 formed in the downstream side surface 25*a* of the diaphragm outer ring 25, and flows into the gap portion 41 which is formed by the inner surface of the inner casing 20 of the turbine stage on the further downstream side and the outer surface of the diaphragm outer ring 25. Thus, the inner surface of the inner casing 20 and the outer surface of the diaphragm outer ring 25 are directly cooled by the cooling medium CM.

The action of the steam turbine 10 is described below with reference to FIG. 1 to FIG. 3.

As shown in FIG. 1, the steam introduced from the steam inlet pipe 30 into the steam turbine 10 is guided to the nozzle box 32. The steam guided to the nozzle box 32 is discharged from the first stage stationary blade 27 in the nozzle box 32 toward the first stage moving blade 24. And, the steam discharged from the nozzle box 32 flows through the steam passage between the stationary blade 27 arranged in the inner casing 20 and the moving blade 24 implanted in the rotor disk 23 of the turbine rotor 22 to rotate the turbine rotor 22. The steam having flown through the inner casing 20 while performing the expansion work and passed through the final stage moving blade 24 is exhausted out of the steam turbine 10 through an exhaust passage (not shown).

The cooling medium CM introduced into the cooling medium passage 40 through the supply pipe 45 flows partially to the downstream side (right side in FIG. 1) (see the arrows in FIG. 1 and FIG. 2) through the gap portion 41 which is formed by the inner surface of the inner casing 20 and the outer surface of the diaphragm outer ring 25 as shown on FIG. 1 and FIG. 2. And, as shown in FIG. 2 and FIG. 3, it passes through the groove portion 42 which is formed in the downstream side surface 25*a* of the diaphragm outer ring 25 and flows into the gap portion 41 on the further downstream which is formed by the inner surface of the inner casing 20 of the turbine stage on the further downstream side and the outer surface of the diaphragm outer ring 25. And, the cooling medium CM having passed through the cooling medium passage 40 corresponding to the final turbine stage is guided into, for example, an exhaust passage (not shown).

Meanwhile, the rest of the cooling medium CM introduced into the cooling medium passage 40 through the supply pipe 45 flows through the gap portion 41 formed by the inner surface of the inner casing 20 and the outer surface of the diaphragm outer ring 25 to the upstream side (left side in FIG. 1) as shown in FIG. 1 (see the arrow in FIG. 1). And, the cooling medium CM passes through the groove portion 42 formed in the downstream side surface 25*a* of the diaphragm outer ring 25 toward outside in the radial direction as shown in FIG. 1. And, it flows into the gap portion 41 on the further upstream side formed by the inner surface of the inner casing 20 of the turbine stage on the further upstream side and the outer surface of the diaphragm outer ring 25. The cooling medium CM having passed through the second turbine stage toward the upstream side flows between the steam inlet pipe 30 sealed by the seal ring 31 and the inner surface of the inlet portion 20*a* of the inner casing 20 to flow into the space between the inner casing 20 and the outer casing 21. And, the cooling medium CM having flown between the inner casing 20 and the outer casing 21 is guided into, for example, an exhaust passage (not shown).

Thus, the cooling medium CM flows between the inner casing 20 and the diaphragm outer ring 25 to cool the inner casing 20 and the diaphragm outer ring 25. And, the outer surface of the diaphragm outer ring 25 is cooled, so that heat transfer from the outer surface of the diaphragm outer ring 25 to the inner surface of the inner casing 20 due to heat radiation can be suppressed.

As described above, the steam turbine 10 of the first embodiment has the cooling medium passage 40 for flowing the cooling medium CM between the inner casing 20 and the diaphragm outer ring 25, so that the inner surface of the inner casing 20 and the outer surface of the diaphragm outer ring 25 can be cooled directly. Therefore, the inner casing 20 and the diaphragm outer ring 25 can be cooled efficiently.

Since the inner casing 20 is cooled as described above, the inner casing 20 can be configured of a material such as the same high Cr heat resistant steel as before even when the steam supplied to the steam turbine 10 is set to a temperature such as about 650 to 750° C. Thus, the production cost can be suppressed from increasing and the efficiency of the steam turbine 10 can be improved.

Second Embodiment

The steam turbine 10 of the second embodiment has the same structure as that of the steam turbine 10 of the first embodiment except that the structure of the cooling medium passage 40 in the steam turbine 10 of the first embodiment described above was changed. Here, a cooling medium passage 50 different from the structure of the cooling medium passage 40 in the steam turbine 10 of the first embodiment is described mainly.

Figure 4:
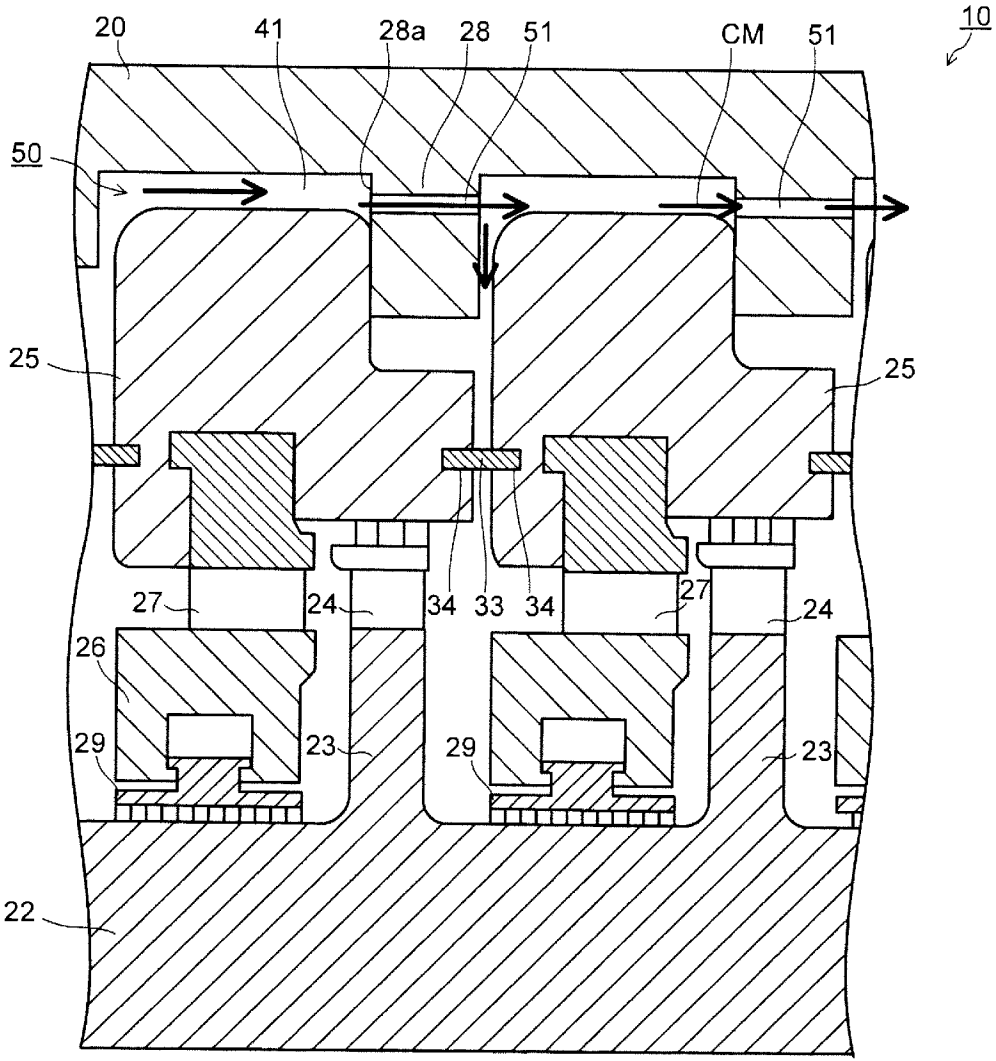
FIG. 4 is a diagram showing a cross section (meridional cross section) including the central axis of a turbine rotor for illustrating a structure of a cooling medium passage of the steam turbine according to a second embodiment.

FIG. 4 is a diagram showing a cross section (meridional cross section) including the central axis of a turbine rotor 22 for illustrating a structure of the cooling medium passage 50 of the steam turbine 10 according to the second embodiment. Like component parts corresponding to those of the structure of the steam turbine 10 of the first embodiment are denoted by like reference numerals, and overlapped descriptions will be omitted or simplified (the same is applied to the following embodiments).

As shown in FIG. 4, the cooling medium passage 50 comprises a plurality of gap portions 41 and a through hole 51. Each of gap portions 41 corresponds with each of the stages of the turbine stationary blades (e.g. the turbine stator cascade). Each of gap portions 41 is formed between the inner surface of the inner casing 20 and the outer surface of at least one of the diaphragm outer rings 25, so that each of gap portions 41 is axially separated by protruded portions 28, respectively. Through hole 51 is formed in the protruded portion 28 to communicate with the gap portion 41. In other words, through hole 51 couples and connects two of axially adjacently located gap portions 41 to communicate. FIG. 4 shows a structure of the cooling medium passage 50 for flowing the cooling medium CM introduced into the cooling medium passage 50 through the supply pipe 45 partially to the downstream side (right side in FIG. 4), and the cooling medium passage 50 on the upstream side also has the same structure.

Then, the action of the cooling medium CM flowing through the cooling medium passage 50 is described with reference to FIG. 4.

The cooling medium CM introduced into the cooling medium passage 50 through the supply pipe 45 flows partially to the downstream side (right side in FIG. 4) through the gap portion 41 formed by the inner surface of the inner casing 20 and the outer surface of the diaphragm outer ring 25 (see the arrows in FIG. 4). And, it flows through the through hole 51 formed in the protruded portion 28 and into the gap portion 41 on the further downstream side which is formed by the inner surface of the inner casing 20 of the turbine stage on the further downstream side and the outer surface of the diaphragm outer ring 25. And, the cooling medium CM having passed through the cooling medium passage 50 corresponding to the final turbine stage is guided into, for example, an exhaust passage (not shown).

Meanwhile, the rest of the cooling medium CM introduced into the cooling medium passage 50 through the supply pipe 45 flows to the upstream side (left side in FIG. 4) through the gap portion 41 which is formed by the inner surface of the inner casing 20 and the outer surface of the diaphragm outer ring 25. And, it flows through the through hole 51 formed in the protruded portion 28 and into the gap portion 41 on the further upstream side which is formed by the inner surface of the inner casing 20 of the turbine stage on the further upstream side and the outer circumferential surface of the diaphragm outer ring 25. The cooling medium CM which has passed the second turbine stage toward the upstream side flows between the steam inlet pipe 30 sealed by the seal ring 31 and the inner surface of the inlet portion 20*a* of the inner casing 20 to flow into the space between the inner casing 20 and the outer casing 21 (see FIG. 1). And, the cooling medium CM having flown between the inner casing 20 and the outer casing 21 is guided into, for example, an exhaust passage (not shown).

Thus, the cooling medium CM flows between the inner casing 20 and the diaphragm outer ring 25 to cool the inner casing 20 and the diaphragm outer ring 25. And, the outer surface of the diaphragm outer ring 25 is cooled, so that heat transfer from the outer surface of the diaphragm outer ring 25 to the inner surface of the inner casing 20 due to heat radiation can be suppressed.

As described above, the steam turbine 10 of the second embodiment has the cooling medium passage 50 for flowing the cooling medium CM between the inner casing 20 and the diaphragm outer ring 25, so that the inner surface of the inner casing 20 and the outer surface of the diaphragm outer ring 25 can be cooled directly. Therefore, the inner casing 20 and the diaphragm outer ring 25 can be cooled efficiently.

Since the inner casing 20 is cooled as described above, the inner casing 20 can be configured of a material such as the same high Cr heat resistant steel as before even when the steam supplied to the steam turbine 10 is set to a temperature, such as about 650 to 750° C. Thus, the production cost can be suppressed from increasing and the efficiency of the steam turbine 10 can be improved.

Third Embodiment

The steam turbine 10 of the third embodiment has the same structure as that of the steam turbine 10 of the first embodiment except that the structure of the cooling medium passage 40 in the steam turbine 10 of the first embodiment described above was changed. Here, a cooling medium passage 60 different from the structure of the cooling medium passage 40 in the steam turbine 10 of the first embodiment is described mainly.

Figure 5:
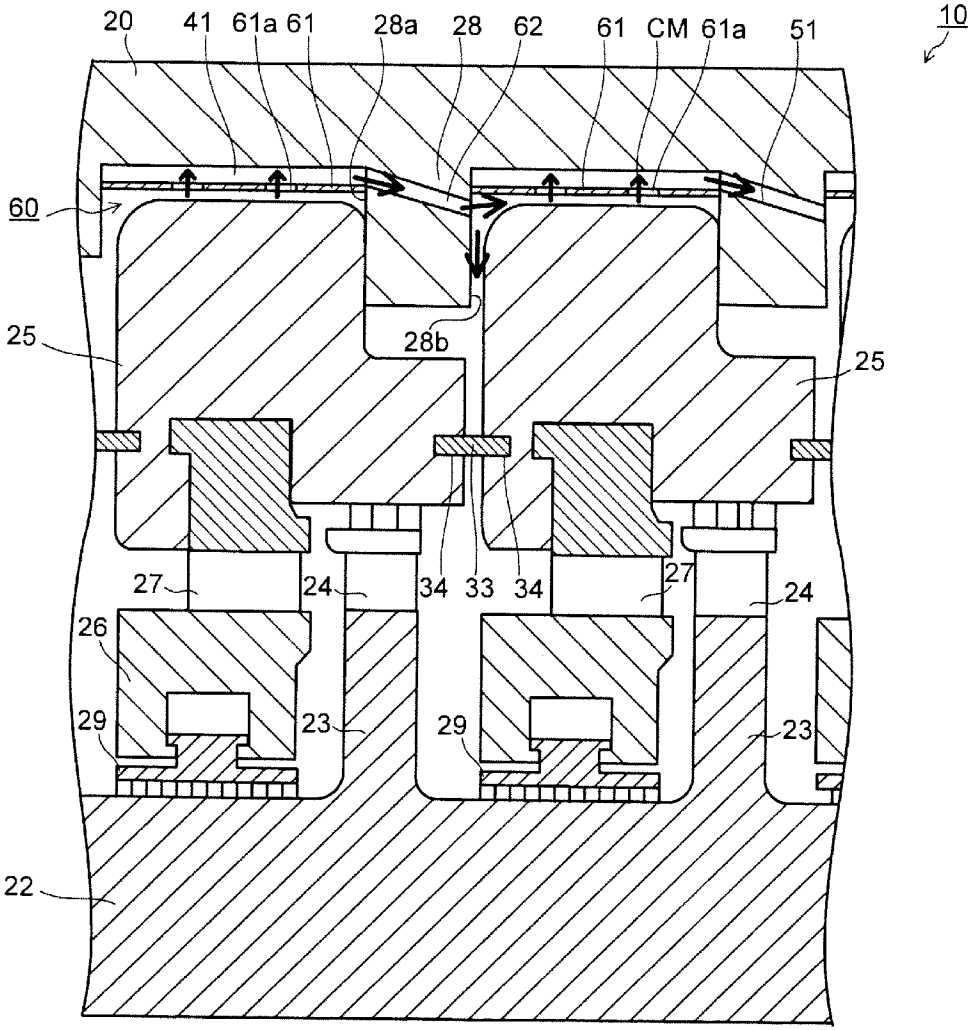
FIG. 5 is a diagram showing a cross section (meridional cross section) including the central axis of a turbine rotor for illustrating a structure of a cooling medium passage of the steam turbine according to a third embodiment.

FIG. 5 is a diagram showing a cross section (meridional cross section) including the central axis of a turbine rotor 22 for illustrating a structure of the cooling medium passage 60 of the steam turbine 10 according to a third embodiment.

As shown in FIG. 5, the cooling medium passage 60 is provided with a plurality of gap portions 41, each of which is formed between the inner surface of the inner casing 20 and the outer surface of at least one of the diaphragm outer ring 25. Each of gap portions 41 corresponds with each of the stages of the turbine stationary blades (e.g. the turbine stator cascade), so that each of gap portions 41 is axially separated by protruded portions 28, respectively. And, a plate-like member 61, in which plural holes 61*a* are formed, is disposed in the circumferential direction in each of the gap portions 41 between the inner surface of the inner casing 20 and the outer surface of the diaphragm outer ring 25.

The plate-like member 61 has a cylindrical shape as a whole by combining the divided pieces which are divided into plural in the circumferential direction. For example, both ends of the individual divided pieces can also be configured to have a flange portion (not shown) for fixing by combining the mutually adjacent plate-like members in the circumferential direction. Otherwise, the individual divided pieces of the plate-like member 61 are fixed between adjacent the protruded portions 28 in the axial direction of the turbine rotor 22, so that it becomes possible to form a cylindrical shape as a whole without disposing the above-described flange portion for fixing the adjacent divided pieces in the circumferential direction. The material for forming the plate-like member 61 is not limited to a particular one if it is a material which does not cause thermal deformation or the like. The plate-like member 61 can be configured of the same material as that used to configure, for example, the inner casing 20.

The holes 61*a* formed in the plate-like member 61 are preferably determined to have a bore such that the cooling medium CM can be spouted at a prescribed speed from the side of the diaphragm outer ring 25 toward the inner surface of the inner casing 20. When the holes 61*a* formed in the plate-like member 61 are round, their diameters are preferably determined to fall in a range of 1 mm to 10 mm.

A distance from the outer surface of the plate-like member 61 to the inner surface of the inner casing 20 is preferably set to a distance that the cooling medium CM spouted through the holes 61*a* formed in the plate-like member 61 can be collided effectively to the inner surface of the inner casing 20. This distance can be determined appropriately by conducting analysis and experiments according to the flow rate and pressure of the cooling medium and the number and arrangement of the holes 61*a*. Thus, the heat transfer between the cooling medium CM and the inner surface of the inner casing 20 can be improved.

As shown in FIG. 5, the cooling medium passage 60 has a through hole 62 which is formed in the protruded portion 28 to communicate with the gap portion 41. In other words, through hole 62 couples and connects two of axially adjacently located gap portions 41 to communicate. The through hole 62 is formed to penetrate from the upstream side surface 28*a* of the protruded portion 28 positioned between the plate-like member 61 and the inner surface of the inner casing 20 to the side surface 28*b* on the downstream side of the protruded portion 28 which is on the side of the diaphragm outer ring 25 than on the side of the plate-like member 61. In other words, a radial position of an inlet of the cooling medium CM of through hole 62 is located between the plate-like member 61 and inner surface of inner casing 20, and the radial position of an outlet of the cooling medium CM of through hole 62 is located between the outer surface of diaphragm outer ring 25 and plate-like member 61, so that cooling medium CM flows through and is spouted through the holes 61*a* of in the plate-like member 61 from an inner side to an outer side.

FIG. 5 shows a structure of the cooling medium passage 60 for flowing the cooling medium CM introduced into the cooling medium passage 60 through the supply pipe 45 partially to the downstream side (right side in FIG. 5), and the cooling medium passage 60 on the upstream side has basically the same structure. In other words, the through hole 62 is formed to penetrate from the downstream side surface 28*b* of the protruded portion 28 positioned between the plate-like member 61 and the inner surface of the inner casing 20 to the upstream side surface 28*a* of the protruded portion 28 which is on the side of the diaphragm outer ring 25 than on the side of the plate-like member 61.

The action of the cooling medium CM flowing through the cooling medium passage 60 is described with reference to FIG. 5.

The cooling medium CM introduced into the cooling medium passage 60 through the supply pipe 45 is partially supplied to the gap portion 41 on the side of the diaphragm outer ring 25 than on the side of the plate-like member 61, and flows to the downstream side (right side in FIG. 5) (see the arrows in FIG. 5). At this time, the cooling medium CM is spouted from the side of the diaphragm outer ring 25 to the inner surface of the inner casing 20 through the holes 61*a* formed in the plate-like member 61. The cooling medium CM spouted through the holes 61*a* collides against the inner surface of the inner casing 20 to cool the inner surface of the inner casing 20. Then, the cooling medium CM flows through the through hole 62 and is guided to the gap portion 41 on the side of the diaphragm outer ring 25 than the side of the plate-like member 61 of the turbine stage on the downstream side. And, the cooling medium CM having passed through the cooling medium passage 60 corresponding to the final turbine stage is guided into, for example, an exhaust passage (not shown).

Meanwhile, the rest of the cooling medium CM introduced into the cooling medium passage 60 through the supply pipe 45 is supplied to the gap portion 41 on the side of the diaphragm outer ring 25 than on the side of the plate-like member 61, and flows to the upstream side (left side in FIG. 5). At this time, the cooling medium CM is spouted from the side of the diaphragm outer ring 25 toward the inner surface of the inner casing 20 through the holes 61*a* formed in the plate-like member 61. The cooling medium CM spouted through the holes 61*a* collides against the inner surface of the inner casing 20 to cool the inner surface of the inner casing 20. Then, the cooling medium CM flows through the through hole 62, and is guided to the gap portion 41 on the side of the diaphragm outer ring 25 than on the side of the plate-like member 61 of the turbine stage of the upstream side. The cooling medium CM having passed through the second turbine stage toward the upstream side flows between the steam inlet pipe 30 sealed by the seal ring 31 and the inner surface of the inlet portion 20*a* of the inner casing 20 and flows into the space between the inner casing 20 and the outer casing 21 (see FIG. 1). And, the cooling medium CM having flown between the inner casing 20 and the outer casing 21 is guided to, for example, an exhaust passage (not shown).

Thus, the cooling medium CM flows between the inner casing 20 and the diaphragm outer ring 25 to cool the inner casing 20 and the diaphragm outer ring 25. And, the outer surface of the diaphragm outer ring 25 is cooled, so that heat transfer from the outer surface of the diaphragm outer ring 25 to the inner surface of the inner casing 20 due to heat radiation can be suppressed.

As described above, the steam turbine 10 of the third embodiment has the cooling medium passage 60 for flowing the cooling medium CM between the inner casing 20 and the diaphragm outer ring 25, so that the inner surface of the inner casing 20 and the outer surface of the diaphragm outer ring 25 can be cooled directly. In addition, the provision of the plate-like member 61 having plural holes 61*a* can cause the cooling medium CM to spout from the side of the diaphragm outer ring 25 toward the inner surface of the inner casing 20 and to collide the cooling medium CM to the inner surface of the inner casing 20. Therefore, the inner casing 20 can be cooled efficiently.

Since the inner casing 20 is cooled as described above, the inner casing 20 can be configured of a material such as the same high Cr heat resistant steel as before even when the steam supplied to the steam turbine 10 is set to a temperature such as about 650 to 750° C. Thus, the production cost can be suppressed from increasing and the efficiency of the steam turbine 10 can be improved.

Fourth Embodiment

The steam turbine 10 of the fourth embodiment has the same structure as that of the steam turbine 10 of the first embodiment except that the structure of the cooling medium passage 40 in the steam turbine 10 of the first embodiment described above was changed. Here, a cooling medium passage 70 different from the structure of the cooling medium passage 40 in the steam turbine 10 of the first embodiment is described mainly.

Figure 6:
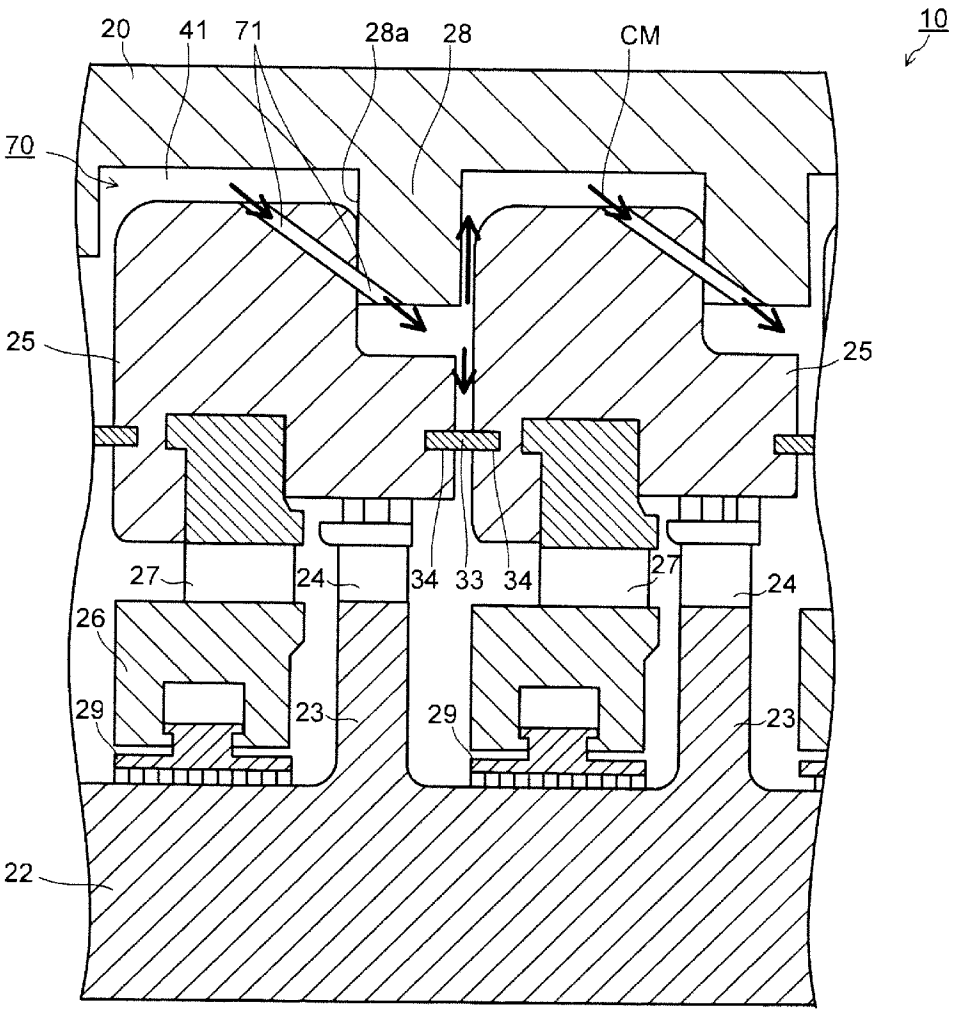
FIG. 6 is a diagram showing a cross section (meridional cross section) including the central axis of a turbine rotor for illustrating a structure of a cooling medium passage of the steam turbine according to a fourth embodiment.

FIG. 6 is a diagram showing a cross section (meridional cross section) including the central axis of a turbine rotor 22 for illustrating a structure of a cooling medium passage 70 of the steam turbine 10 according to a fourth embodiment.

As shown in FIG. 6, the cooling medium passage 70 is provided with a plurality of gap portions 41 and a communication hole 71. Each of gap portions 41 is formed between the inner surface of the inner casing 20 and the outer surface of at least one of the diaphragm outer ring 25, so that each of gap portions 41 is axially separated by protruded portions 28, respectively. Communication hole 71 is formed to communicate axially adjacently located gap portions 41. Communication hole 71 is formed in the diaphragm outer ring 25 and the protruded portion 28, penetrating from the diaphragm outer ring 25 to the protruded portion 28. In other words, communication hole 71 couples and connects two of axially adjacently located gap portions 41 to communicate.

FIG. 6 shows a structure of the cooling medium passage 70 for flowing the cooling medium CM introduced into the cooling medium passage 70 through the supply pipe 45 partially to the downstream side (right side in FIG. 6), and the cooling medium passage 70 on the upstream side also has the same structure.

The action of the cooling medium CM flowing through the cooling medium passage 70 is described below with reference to FIG. 6.

The cooling medium CM introduced into the cooling medium passage 70 through the supply pipe 45 flows partially through the gap portion 41 which is formed by the inner surface of the inner casing 20 and the outer surface of the diaphragm outer ring 25 to the downstream side (right side in FIG. 6) (see the arrows in FIG. 6). And, the cooling medium CM flows through the communication hole 71 which is formed from the diaphragm outer ring 25 to the protruded portion 28 to flow into the gap portion 41 on the further downstream side which is formed by the inner surface of the inner casing 20 of the turbine stage on the further downstream side and the outer surface of the diaphragm outer ring 25. And, the cooling medium CM having passed through the cooling medium passage 70 corresponding to the final turbine stage is guided into, for example, an exhaust passage (not shown).

Meanwhile, the rest of the cooling medium CM introduced into the cooling medium passage 70 through the supply pipe 45 flows through the gap portion 41 which is formed by the inner surface of the inner casing 20 and the outer surface of the diaphragm outer ring 25 to the upstream side. And, it flows from the side of the protruded portion 28 into the communication hole 71 which is formed from the diaphragm outer ring 25 to the protruded portion 28 and passes through the communication hole 71. And, the cooling medium CM flows into the gap portion 41 which is formed by the inner surface of the inner casing 20 of the turbine stage on the upstream side and the outer surface of the diaphragm outer ring 25. In other words, the flow of the cooling medium CM to the upstream side becomes a flow directed opposite to the direction indicated by the arrows indicating the flow of the cooling medium CM shown in FIG. 6.

The cooling medium CM having passed through the second turbine stage toward the upstream side flows between the steam inlet pipe 30 sealed by the seal ring 31 and the inner surface of the inlet portion 20*a* of the inner casing 20 to enter into the space between the inner casing 20 and the outer casing 21 (see FIG. 1). And, the cooling medium CM having flown between the inner casing 20 and the outer casing 21 is guided into, for example, an exhaust passage (not shown).

Thus, the cooling medium CM flows between the inner casing 20 and the diaphragm outer ring 25 to cool the inner casing 20 and the diaphragm outer ring 25. And, the outer surface of the diaphragm outer ring 25 is cooled, so that heat transfer from the outer surface of the diaphragm outer ring 25 to the inner surface of the inner casing 20 due to heat radiation can be suppressed.

As described above, the steam turbine 10 of the fourth embodiment has the cooling medium passage 70 for flowing the cooling medium CM between the inner casing 20 and the diaphragm outer ring 25, so that the inner surface of the inner casing 20 and the outer surface of the diaphragm outer ring 25 can be cooled directly. Therefore, the inner casing 20 and the diaphragm outer ring 25 can be cooled efficiently.

Since the inner casing 20 is cooled as described above, the inner casing 20 can be configured of a material such as the same high Cr heat resistant steel as before even when the steam supplied to the steam turbine 10 is set to a temperature such as about 650 to 750° C. Thus, the production cost can be suppressed from increasing and the efficiency of the steam turbine 10 can be improved.

Fifth Embodiment

The steam turbine 10 according to a fifth embodiment has a structure not provided with the cooling mechanism based on the cooling medium in the steam turbine 10 of the first embodiment described above. Therefore, the steam turbine 10 of the fifth embodiment has a structure not provided with the supply pipe 45, the cooling medium passage 40, the cooling medium leakage preventing member 33 and the fitting groove 34 for fitting the cooling medium leakage preventing member 33 shown in FIG. 1.

The steam turbine 10 of the fifth embodiment is provided with a heat insulating structure 80 instead of the cooling mechanism based on the cooling medium provided in the steam turbines according to the first embodiment to the fourth embodiment described above.

Figure 7:
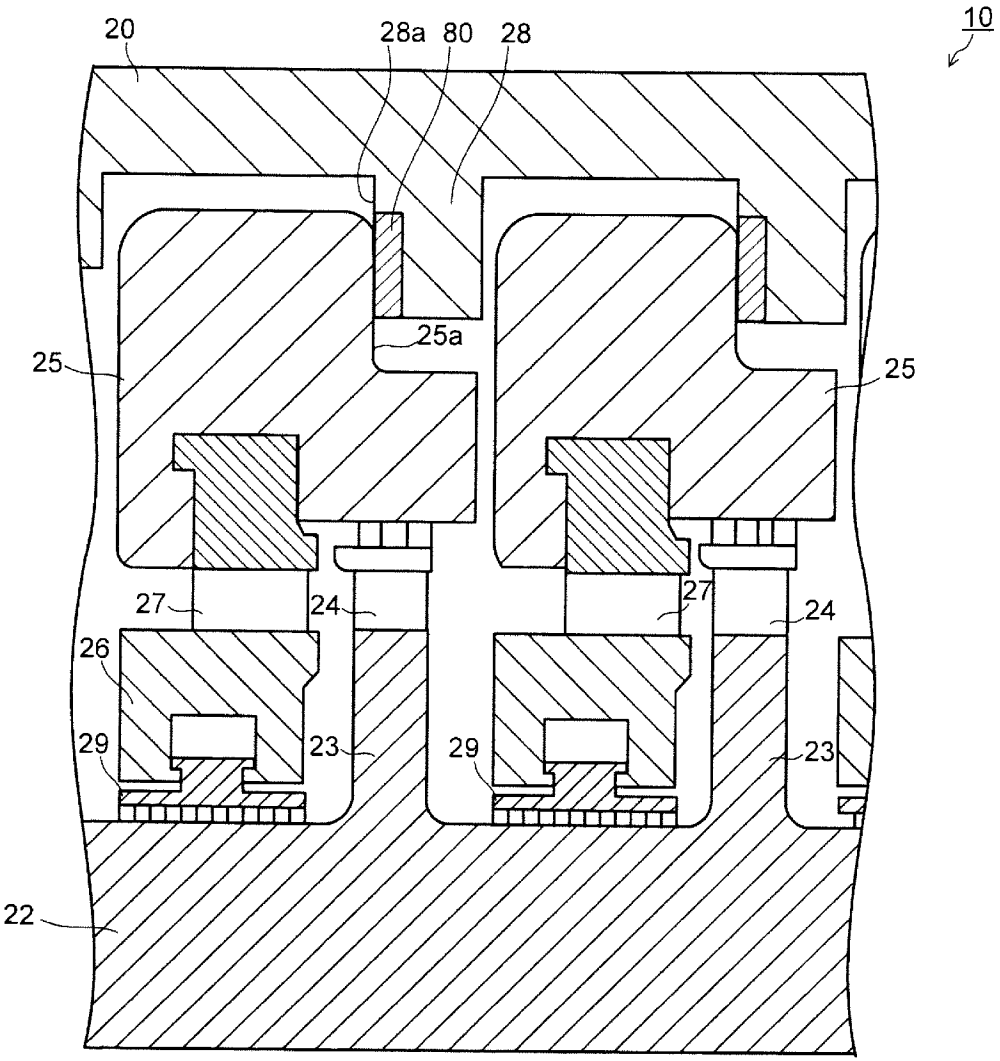
FIG. 7 is a diagram showing a cross section (meridional cross section) including the central axis of a turbine rotor for illustrating a structure of a heat insulating structure of the steam turbine according to a fifth embodiment.

FIG. 7 is a diagram showing a cross section (meridional cross section) including the central axis of a turbine rotor 22 for illustrating a structure of the heat insulating structure 80 of the steam turbine 10 according to the fifth embodiment.

As shown in FIG. 7, an upstream side surface 28*a* of the protruded portion 28, which is in contact with a downstream side surface 25*a* of the diaphragm outer ring 25, comprises the heat insulating structure 80. Instead of having the heat insulating structure 80 for the upstream side surface 28*a* of the protruded portion 28, the downstream side surface 25*a* of the diaphragm outer ring 25, which is in contact with the upstream side surface 28*a* of the protruded portion 28, may comprises the heat insulating structure 80. Or, both of the upstream side surface 28*a* of protruded portion 28 and the downstream side surface 25*a* of diaphragm outer ring 25 may comprise the heat insulating structure 80.

The heat insulating structure 80 makes it hard to transfer heat from the diaphragm outer ring 25 to the protruded portion 28 which is arranged in contact with it. The heat insulating structure 80 is configured by having, for example, a member having a thermal conductivity smaller than that of the material configuring the inner casing 20 (including the protruded portion 28) at the upstream side surface 28*a* of the protruded portion 28, which is contacted to the downstream side surface 25*a* of the diaphragm outer ring 25. The inner casing 20 is configured of a material such as a high Cr heat resistant steel, so that the heat insulating structure 80 can be configured of a material having a thermal conductivity smaller than that.

In this case, the heat insulating structure 80 may be configured by forming a film by spraying or coating the above-described material having a low thermal conductivity to the upstream side surface 28*a* of the protruded portion 28 which is in contact with the downstream side surface 25*a* of the diaphragm outer ring 25. And, the heat insulating structure 80 may be configured of a member having a circular shape (a ring shape) by combining two semicircular plate-like members made of the above-described material having a low thermal conductivity. For example, this semicircular plate-like member is fixed by fitting in and welding to the groove formed along the circumferential direction in the upstream side surface 28*a* of the protruded portion 28, which is in contact with the downstream side surface 25*a* of the diaphragm outer ring 25.

The heat insulating structure 80 may be configured by, for example, increasing the surface roughness of the upstream side surface 28*a* of the protruded portion 28 larger than the surface roughness of the downstream side surface 25*a* of the diaphragm outer ring 25 to decrease the contact area between the downstream side surface 25*a* of the diaphragm outer ring 25 and the upstream side surface 28*a* of the protruded portion 28. The heat insulating structure 80 may be configured by increasing the surface roughness of the downstream side surface 25*a* of the diaphragm outer ring 25 larger than the surface roughness of the upstream side surface 28*a* of the protruded portion 28.

The surface roughness is preferably adjusted such that the contact area between the downstream side surface 25*a* of the diaphragm outer ring 25 and the upstream side surface 28*a* of the protruded portion 28 becomes 70% or below of the contact area when both surfaces are wholly contacted completely. It is because the heat insulating effect lowers if the contact area exceeds it.

As described above, according to the steam turbine 10 of the fifth embodiment, heat conduction from the diaphragm outer ring 25 to the protruded portion 28 is suppressed and the temperature of the inner casing 20 can be suppressed from increasing by determining the upstream side surface 28*a* of the protruded portion 28 which comes into contact with the downstream side surface 25*a* of the diaphragm outer ring 25 as the heat insulating structure 80.

Thus, since the temperature of the inner casing 20 can be suppressed from increasing, the inner casing 20 can be configured of a material such as the same high Cr heat resistant steel as before even when the temperature of the steam to be supplied to the steam turbine 10 is set to, for example, about 650 to 750° C. Thus, the production cost can be suppressed from increasing and the efficiency of the steam turbine 10 can be improved.

The heat insulating structure 80 may be applied to the steam turbines of the first embodiment to the fourth embodiment described above. Specifically, the upstream side surface 28*a* of the protruded portion 28 which comes into contact with the downstream side surface 25*a* of the diaphragm outer ring 25 may be determined to be the above-described heat insulating structure 80. Thus, both the cooling effect of the cooling medium CM and the heat insulating effect by the heat insulating structure 80 can be obtained, and the temperature of the inner casing 20 can be suppressed from increasing effectively.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A steam turbine, comprising:

a double-structure casing comprising an outer casing and an inner casing;

a steam inlet pipe configured to feed steam into the inner casing through the outer casing;

a turbine rotor operatively disposed in the inner casing;

plural stages of moving blades implanted in the turbine rotor;

plural stages of stationary blades circumferentially provided between a diaphragm outer ring and a diaphragm inner ring, the stages of the stationary blades being arranged alternately with the stages of the moving blades, respectively, in an axial direction of the turbine rotor;

a cooling medium passage formed between the inner casing and the diaphragm outer ring, configured to flow a cooling medium;

a supply pipe configured to supply the cooling medium from outside of the outer casing to the cooling medium passage; and an exhaust passage configured to guide a working fluid passed through a final stage moving blade to the outside of the outer casing, wherein the moving blade and the stationary blade constitute a stage of turbine, the inner casing comprises a plurality of protruded portions at an inner surface thereof, each of the protruded portions circumferentially protruding toward the turbine rotor correspondingly with each of the stages of the turbine, each of the protruded portions having an upstream side surface contacting with a downstream side surface of each of the diaphragm outer rings, respectively; and wherein the cooling medium passage comprises:

a plurality of gap portions, each of the gap portions being formed between the inner surface of the inner casing and an outer surface of at least one of the diaphragm outer rings; and a communication hole formed in both of the diaphragm outer ring and the protruded portion, the communication hole coupling adjacent gap portions to communicate.

2. A steam turbine, comprising:

a double-structure casing comprising an outer casing and an inner casing;

a steam inlet pipe configured to feed steam into the inner casing through the outer casing;

a turbine rotor operatively disposed in the inner casing;

plural stages of moving blades implanted in the turbine rotor;

plural stages of stationary blades circumferentially provided between a diaphragm outer ring and a diaphragm inner ring, the stages of the stationary blades being arranged alternately with the stages of the moving blades, respectively, in an axial direction of the turbine rotor;

a cooling medium passage formed between the inner casing and the diaphragm outer ring, configured to flow a cooling medium;

a supply pipe configured to supply the cooling medium from outside of the outer casing to the cooling medium passage;

an exhaust passage configured to guide a working fluid passed through final stage moving blade to an outside of the outer casing; and a plate-like member formed with plural holes and disposed in a circumferential direction between an inner surface of the inner casing and an outer surface of the diaphragm outer ring in the gap portion;

wherein the moving blade and the stationary blade constitute a stage of turbine, the inner casing comprises a plurality of protruded portions at the inner surface thereof, each of the protruded portions circumferentially protruding toward the turbine rotor correspondingly with each of the stages of the turbine, each of the protruded portions having an upstream side surface contacting with a downstream side surface of each of the diaphragm outer rings, respectively; and wherein the cooling medium passage comprises:

a plurality of gap portions, each of the gap portions being formed between the inner surface of the inner casing and the outer surface of at least one of the diaphragm outer rings; and a through hole formed in the protruded portion, the through hole coupling adjacent gap portions to communicate;

wherein an inlet of the cooling medium of the through hole is positioned between the plate-like member and the inner surface of the inner casing;

wherein an outlet of the cooling medium of the through hole is positioned between the outer surface of the diaphragm outer ring and the plate-like member; and wherein the cooling medium flows from a side of the diaphragm outer ring toward the inner surface of the inner casing via the plural holes in the plate-like member.

3. A steam turbine, comprising:

a double-structure casing comprising an outer casing and an inner casing;

a steam inlet pipe configured to feed steam into the inner casing through the outer casing;

a turbine rotor operatively disposed in the inner casing;

plural stages of moving blades implanted in the turbine rotor;

plural stages of stationary blades circumferentially provided between a diaphragm outer ring and a diaphragm inner ring, the stages of the stationary blades being arranged alternately with the stages of the moving blades, respectively, in an axial direction of the turbine rotor;

a cooling medium passage formed between the inner casing and the diaphragm outer ring, configured to flow a cooling medium;

a supply pipe configured to supply the cooling medium from outside of the outer casing to the cooling medium passage; and an exhaust passage configured to guide a working fluid passed through final stage moving blade to an outside of the outer casing, wherein the moving blade and the stationary blade constitute a stage of turbine, the inner casing comprises a plurality of protruded portions at an inner surface thereof, each of the protruded portions circumferentially protruding toward the turbine rotor correspondingly with each of the stages of the turbine, each of the protruded portions having an upstream side surface contacting with a downstream side surface of each of the diaphragm outer rings, respectively; and wherein the cooling medium passage comprises:

a plurality of gap portions, each of the gap portions being formed between the inner surface of the inner casing and an outer surface of at least one of the diaphragm outer rings; and a groove portion radially formed in the downstream side surface, the groove portion contacting with the upstream side surface of the protruded portion, of at least one of the diaphragm outer rings, the groove portion coupling adjacent gap portions to communicate.

4. The steam turbine according to claim 3, further comprising a heat insulating structure provided at least one of the upstream side surface of the protruded portion and the downstream side surface of the diaphragm outer ring.

5. The steam turbine according to claim 4, wherein the heat insulating structure comprises a member having a thermal conductivity smaller than that of a material of the inner casing or the diaphragm outer ring.

6. The steam turbine according to claim 3, wherein a surface roughness of a contacting surface of either one of the downstream side surface of the diaphragm outer ring and the upstream side surface of the protruded portion is larger than the surface roughness of the other contacting surface to decrease a contact area of the contacting surfaces.

7. A steam turbine, comprising:

a double-structure casing comprising an outer casing and an inner casing;

a steam inlet pipe configured to feed steam into the inner casing through the outer casing;

a turbine rotor operatively disposed in the inner casing;

plural stages of moving blades implanted in the turbine rotor;

plural stages of stationary blades circumferentially provided between a diaphragm outer ring and a diaphragm inner ring, the stages of the stationary blades being arranged alternately with the stages of the moving blades, respectively, in an axial direction of the turbine rotor, the moving blade and the stationary blade constituting a stage of turbine;

a plurality of protruded portions provided at an inner surface of the inner casing correspondingly with each of the stages of the turbine, each of the protruded portions circumferentially protruding toward the turbine rotor, each of the protruded portions respectively having an upstream side surface contacting with a downstream side surface of each of the diaphragm outer rings;

a heat insulating structure provided at at least one of the upstream side surface of the protruded portion and the downstream side surface of the diaphragm outer rings; and an exhaust passage configured to guide a working fluid passed through a final stage moving blade to an outside of the outer casing.

8. The steam turbine according to claim 7, wherein the heat insulating structure comprises a member having a thermal conductivity smaller than that of a material of the inner casing or the diaphragm outer ring.

9. The steam turbine according to claim 7, wherein a surface roughness of a contacting surface of either one of the downstream side surface of the diaphragm outer ring and the upstream side surface of the protruded portion is larger than the surface roughness of the other contacting surface to decrease a contact area of the contacting surfaces.

10. A heat insulating method tar a steam turbine comprising a double-structure easing comprising an outer casing and an inner casing;

a steam inlet pipe configured to feed steam into the inner casing through the outer casing;

a turbine rotor operatively disposed in the inner casing;

plural stages of moving blades implanted in the turbine rotor;

plural stages of stationary blades circumferentially provided between a diaphragm outer ring and a diaphragm inner ring, the stages of the stationary blades being arranged alternately with the stages of the moving blades, respectively, in an axial direction of the turbine rotor, the moving blade and the stationary blade constituting a stage of turbine;

a plurality of protruded portions provided at an inner surface of the inner casing correspondingly with each of the stages of the turbine, each of the protruded portions circumferentially protruding toward the turbine rotor; and an exhaust passage configured to guide a working fluid passed through a final stage moving blade to an outside of the outer casing, the method comprising:

providing a heat insulating structure at at least one of an upstream side surface of the protruded portion and a downstream side surface of the diaphragm outer ring, to block transfer of heat from the diaphragm outer ring to the protruded portion; and contacting the upstream side surface of each of the protruded portions with the downstream side surface of each of the diaphragm outer rings respectively, interposing the heat insulating structure.

* * * * *